US005425586A

United States Patent [19]

Berson

[11] Patent Number: 5,425,586

[45] **Date of Patent: * Jun. 20, 1995**

[54] APPARATUS AND METHOD OF CREATING PRE-FORMED IMAGES ON A THERMAL RIBBON USED IN A POSTAGE DISPENSING DEVICE

[75] Inventor: William Berson, Westport, Conn.

[73] Assignee: Pitney Bowes Inc., Stamford, Conn.

[ * ] Notice: The portion of the term of this patent subsequent to Feb. 28, 2012 has been disclaimed.

[21] Appl. No.: 169,695

[22] Filed: Dec. 20, 1993

[51] Int. Cl.[6] ..... B41J 2/325

[52] U.S. Cl. ..... 400/120.01; 400/120.16; 101/91

[58] Field of Search ..... 400/120, 120.01, 120.16; 346/1.1; 101/91

[56] References Cited

U.S. PATENT DOCUMENTS

| | | | |
|---|---|---|---|
| 4,515,487 | 5/1985 | Minami | 400/126 |
| 4,588,996 | 5/1986 | Ross et al. | 400/120 |
| 4,746,234 | 5/1988 | Harry | 101/91 |
| 4,836,697 | 6/1989 | Plotnick | 400/120 |
| 4,854,754 | 8/1989 | Miura et al. | 400/120 |
| 4,895,465 | 1/1990 | Mecke et al. . | |
| 5,099,256 | 3/1992 | Anderson | 346/1.1 |

FOREIGN PATENT DOCUMENTS 0189269 2/1992 European Pat. Off. .

*Primary Examiner*—Edgar S. Burr
*Assistant Examiner*—John S. Hilten
*Attorney, Agent, or Firm*—Ronald Reichman; Melvin J. Scolnick

[57] ABSTRACT

A postage dispensing device that prints a postage indicia using a two step process. A thermal ribbon is provided which has pre-formed images on a major portion of the thermal ribbon that is applied with a hot melt ink jet printer. Inked areas are provided on the thermal ribbon where an image is generated by a dot matrix thermal printer. The pre-formed images represent non-variable portion of a postage indicia whereas the images formed by the thermal printer represent variable data of the postage indicia. The use of a hot melt ink jet printer allows one to alter the pre-formed image as required and allows a variety of colors to be used.

11 Claims, 1 Drawing Sheet

APPARATUS AND METHOD OF CREATING PRE-FORMED IMAGES ON A THERMAL RIBBON USED IN A POSTAGE DISPENSING DEVICE

BACKGROUND OF THE INVENTION

With the rapid advancements in the field of printing, consideration of newly developed printing techniques are being considered for use in the field of postage dispensing. Heretofore, postage dispensing apparatus, for the most part, have used mechanical components for the purpose of printing postage indicia upon mail pieces. In the recent past, electronic postage dispensing apparatus have been developed, but even these electronic devices relied upon mechanical printing components that were in communication with electronic accounting units. Needless to say, such postage dispensing devices are relatively expensive.

Many publications have discussed and suggested the use of dot matrix printers in postage dispensing apparatus. In fact, recent changes in postal regulations allow mailers to use ink jet printers for the printing of certain non-critical data on mail pieces. As a result, it appears to be a matter of time before postal regulations are changed to allow more extensive use of dot matrix printers. Of the contemporary printing techniques, the use of thermal printing for a postage dispensing device appears attractive and has been disclosed in a number of articles and patents. The advantages offered by thermal printing is that of low cost and reliability. In concurrently filed patent applications entitled "Postage Dispensing Apparatus Having a thermal Printer and Method of Using the same (E-157) and Postage Dispensing Device with Asynchronous Indicia Printing Operation (E-156)", both assigned to the assignee of the instant patent application, schemes are described for using thermal ribbons with pre-formed images thereon. Although these represent advanced concepts in the field of postage dispensing, they do not teach ways of customizing and readily altering the pre-formed images that are applied to a thermal ribbon.

SUMMARY OF THE INVENTION

A scheme has been devised for creating a thermal ribbon which has pre-formed images thereon that can be easily varied to serve the need of the mailer. These pre-formed images are of the mailer's permanent data on the indicia such as the name of the city and state from which the mail is to be sent, the meter number of the customer's postage dispensing device, and a slogan and logo unique to the customer. Another portion of the ribbon has inked areas on which there is no pre-formed image and on which variable data, such as postage amount and data can be printed. The pre-formed images in accordance with the instant invention are formed using a hot melt ink jet printer. A pair of pressure rollers is provided whereby upon a mail piece being conveyed between the ribbon with the pre-formed images and the pressure rollers, the pre-formed images are transferred to the mail piece. Downstream from the pressure rollers is a thermal printhead that prints data on that position of the mail piece that is engaged with the inked area of the thermal ribbon. Of course, the data printed by the thermal printhead will be variable data; whereas, that portion printed as a result of the pre-formed image and pressure is non-variable data. Through the use of a hot melt ink jet printer, the pre-formed images can be readily and inexpensively tailored for the postage dispensing apparatus of each mailer. This is particularly useful for the mailer's ad slogan. As is known, an ad slogan is a customized message that is printed on a mailer's mail pieces along with the postage indicia. In addition, a multiple color indicia can be imprinted through the practice of the instant invention.

BRIEF DESCRIPTION OF THE DRAWING

In the accompanying drawing, like numbers are used to indicate like parts in the different figures and; wherein.

DETAILED DESCRIPTION OF THE PREFERRED EMBODIMENT

Figure 1:
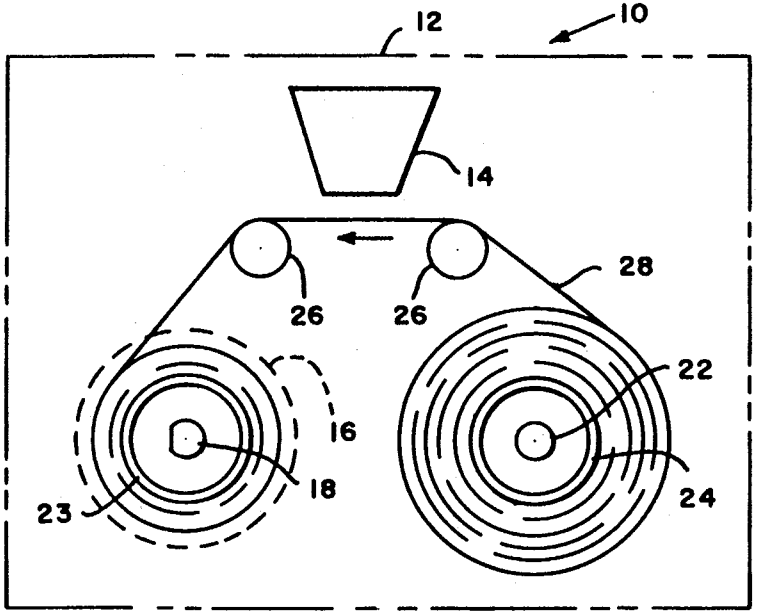
FIG. 1 is a longitudinal, cross sectional view showing a thermal ribbon spaced from a hot melt ink jet.

With reference now to FIG. 1, a description will be given of the manner in which pre-formed images can be applied to a thermal ribbon. A thermal printer is shown generally at 10 and has housing 12 that supports a hot melt ink jet printer 14. Such hot melt ink jet printers 14 are commercially available as for example from Dataproducts Inc. of Woodland Hills, Calif. and Spectra, Inc. of Hanover, N.H. The housing 12 supports a motor 16 that is connected to a spindle 18 for driving the same. Mounted on the spindle 18 is a take-up spool 20. Another spindle 22 is rotatably supported by the housing 12 and is shown with a supply reel 24 mounted thereon. Also supported by the housing is a pair of guide pins 26 for the purpose of guiding a thermal ribbon 28 that is disposed on the reel 24 past the hot melt ink jet printer 14 and about the spool 20.

Figure 2:
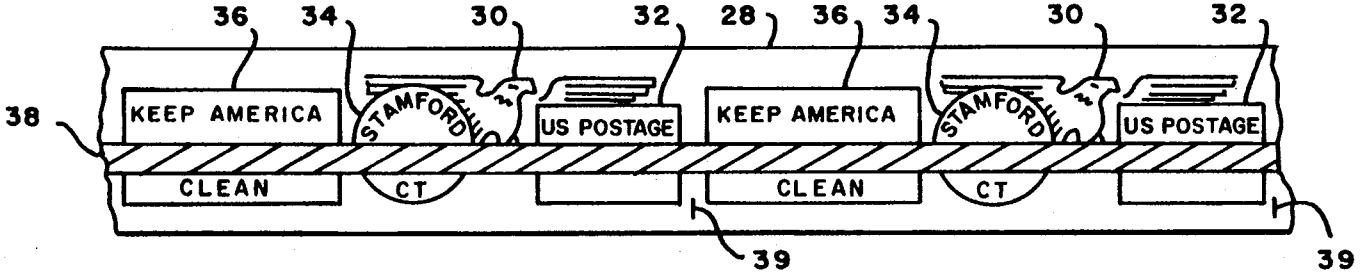
FIG. 2 is a plan view of a ribbon that incorporates features of the instant invention.

With reference to FIG. 2, the thermal ribbon 28 is shown having preformed logo 30, postage block 32, data circle 34 and a slogan 36. The ribbon is a film, such as a polyester film, and has an inked strip 38 extending the length thereof for the purpose of having variable data printed on a mail piece as will be described hereinafter. Both the ink for the hot melt ink jet printer 14 and the inked strip 38 are preferably Carnauba wax based inks and are thus compatible with one another. The preformed images are shown as they would be printed on mail pieces for convenience and illustration. In practice, the images on the thermal ribbon 28 will be mirror images of that which is to be printed on the mail pieces. The ribbon 28 has a plurality of equally spaced timing marks 39 on the side opposite the pre-formed images.

Figure 3:
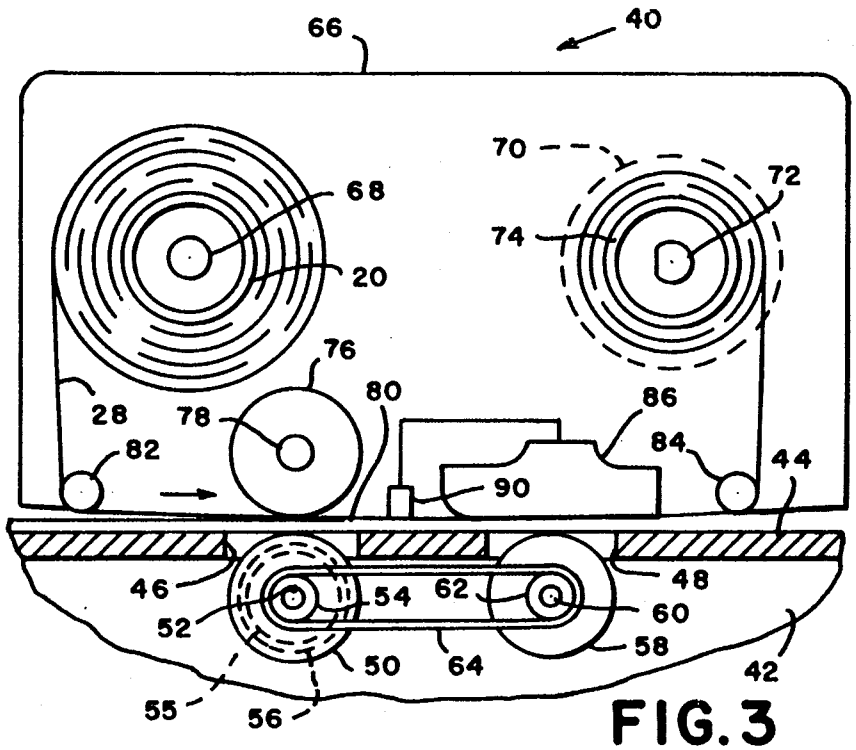
FIG. 3 is a longitudinal, cross sectional view of a postage dispensing apparatus in which the thermal ribbon produced in accordance with the instant invention can be used.

With reference now to FIG. 3, a postage dispensing device is shown generally at 40, in which the thermal ribbon 28 can be used. The postage dispensing device 40 has a lower housing 42 with a longitudinally extending deck 44 at the upper portion thereof. The deck has a pair of lateral openings 46, 48. An impression roller 50 is received within the opening 46 and is mounted on a shaft 52, which shaft is supported by the lower housing 42. The impression roller 50 has a peripheral groove 55 intermediate its ends that is aligned with the inked strip 38 of the ribbon 28 so that no pressure is applied to that position. The shaft 52 supports a pulley 54 on one end and is in engagement with a motor 56 at it's opposite end, the motor being supported within the housing 42.

Another roller 58 is received within the opening 48 and is rotatably supported within the housing by a shaft 60. The shaft 60 supports a pulley 62 that is in longitudinal alignment with the pulley 54. A belt 64 is trained about the pulleys 54, 62 to transfer the drive from the pulley 54 to the pulley 62.

The postage dispensing apparatus 40 has an upper housing 66 that supports a rotatable spindle 68 to which the reel 20 can be mounted. Whereas the reel 20 was a take-up reel in the hot melt ink jet printer 10 shown in FIG. 1, when placed into the postage dispensing device 40 it serves as the supply reel. A motor 70 is supported by the upper housing 66 and is connected to a rotatable spindle 72, upon which a take-up reel 74 can be mounted. In this way, the thermal ribbon 28 with the hot melt pre-formed image can be conveyed across the deck 44, being pulled by the take-up reel 74 and unwound from the supply reel 20 as will be described hereinafter.

An impression roller 76 is disposed upon a shaft 78 that is rotatably supported by the upper housing 66. The roller 76 is in resilient contact with the roller 50. These rollers 50, 76 are made of a resilient material, such as rubber, thereby allowing flat materials, such as mail pieces 80 to pass therethrough while applying pressure to such flat materials. Such pressure will transfer a pre-formed image from the ribbon 28 to the felt material 80. Alternatively, the roller 50 can be a heated rollers so that the fixed image on the ribbon 28 is thermally transferred. Two guide pins 82, 84 are supported by the upper housing 66 adjacent to the deck 44. Intermediate the roller 76 and one of the guide pins 84, is a thermal printer 86. This thermal printer 86 contains a plurality of heating elements, such as seven, and a mail piece 80, such as a stuffed envelope, can be conveyed between the ribbon 28 and rollers 50, 58 and the thermal printer to have an image created thereon. Adjacent to the thermal printer is a sensor 90 that senses a timing mark 39 on the ribbon 28 to coordinate the movement of the ribbon 28 with the enabling of the thermal printer 86.

In operation, a thermal ribbon 28, such as that seen in FIG. 2, will be disposed about the reel 20 mounted on the spindle 68. The reel 74 will be mounted on the spindle 72 and the ribbon will be threaded about the guide pin 82, between the impression rollers 50, 76, between the thermal printer 86 and roller 58, about the guide pin 84 and attached to the take-up roller 74. The motor 50 will be enabled so that the ribbon 28 is driven across the deck 44 as indicated by the arrow in FIG. 3. Simultaneously with the conveyance of the ribbon 54, a mail piece 80 will be conveyed across the deck in synchronization with the ribbon 28. More specifically, the motor 26 will be in synchronization with the motor 50 so that the mail piece 80 and ribbon 28 are driven synchronously. As the envelope 64 passes the impression rollers 20, 32, the fixed image 66 is transferred from the ribbon 28 to the mail piece 80 to create an image thereon. The transfer of such image results from the pressure applied to mail piece 64 as it is conveyed between the ribbon 28 and rollers 50, 76. As stated previously, the image transfer could be accomplished thermally rather than through pressure. Because the fixed images 30, 32, 34 36 were created by a hot melt ink jet, certain advantages are achieved. The colors can be varied to comply with a mailer's wishes and the images, particularly the ad slug 36, can be altered more readily for each mailing. As the envelope passes the portion of the device near the printhead 60, the printhead will be enabled so as to print the variable data at the locations of the postage block 32 and data circle 34 by transferring ink from the inked strip 38 to the mail piece 80. Thereafter, the mail piece 80 is conveyed across the deck to be discharged from the postage dispensing device.

Thus, what has been shown and described is a apparatus and method for depositing pre-formed images on a thermal ribbon with a hot melt ink jet. This offers the advantages of flexibility in the applying of the pre-formed images as the same can be changed more readily to suit the needs of the individual mailers for the printing of the indicia and different color inks can be used.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A postage dispensing device comprising:

a supply of thermal ribbon in said device, said ribbon having a plurality of pre-formed hot melt ink jet images and a ink coating thereon;

a longitudinally extending deck;

a pair of first laterally extending impression rollers in engagement with one another, said impression rollers being a means to transfer said pre-formed images onto a mail piece;

a motor in connection with one of said laterally impression rollers;

a second laterally extending roller located on said deck longitudinally spaced from said pair of first laterally extending rollers;

a thermal printhead spaced relative to said second roller, said thermal printhead being a means to transfer part of said ink coating to a mail piece, and means for conveying said thermal ribbon between said pair of laterally extending pressure rollers and between said printhead and said second roller.

2. The postage dispensing device of claim 1 further including means for conveying a mail piece between said thermal ribbon and one of said rollers of said pair of impression and intermediate said printhead and second roller.

3. The postage dispensing device of claim 1 wherein at least one of said rollers of said first pair of laterally extending impression rollers has a longitudinally extending groove intermediate the ends thereof.

4. The postage dispensing device of claim 1 wherein a said pre-formed images of said thermal ribbon is fixed postage indicia data.

5. A postage dispensing device comprising:

a supply of thermal ribbon in said device, said ribbon having a plurality of pre-formed hot melt ink jet images and a ink coating thereon;

a longitudinally extending deck having a pair of openings therein;

a pair of first laterally extending impression rollers in engagement with one another to form a nip, one of said pair of rollers being received in one of said openings with the nip of said rollers being located along said deck, said impression rollers being a means to transfer said pre-formed images onto a mail piece;

a motor in connection with one of said laterally extending impression rollers;

a second roller received within the second opening of said deck longitudinally spaced from said laterally extending rollers;

a thermal printhead spaced relative to said second roller, said thermal printhead being a means to transfer part of said ink coating to a mail piece; and means for conveying said thermal ribbon between said pair of laterally extending impression rollers and between said printhead and said second roller.

6. The postage dispensing device of claim 5 further including means for conveying an envelope between said thermal ribbon and one of said rollers of said pair of impression rollers and intermediate said printhead and second roller.

7. The postage dispensing device of claim 5 wherein at least one of said rollers of said first pair of laterally extending rollers has a longitudinally extending groove intermediate the ends thereof.

8. The postage dispensing device of claim 5 wherein further one of said rollers of said pair of rollers is a thermal roller.

9. The postage dispensing device of claim 5 wherein said first pair of longitudinally extending rollers are impression rollers.

10. A method of applying a postage indicia on a mail piece, the steps comprising providing a ink ribbon with a ink coating on a first portion;

pre-forming a plurality of postage indicia images on a second portion of said thermal ribbon where there is no inked coating by conveying the thermal ribbon past a hot melt ink jet printer;

placing the thermal ribbon in a printing device;

conveying the pre-formed thermal ribbon between a pair of impression rollers;

conveying a mail piece between one of the rollers and the thermal ribbon for transferring the pre-formed image from the ribbon to a mail piece; and printing data on the mail piece through use a thermal printhead by heating selected portions of the first portion of the thermal ribbon.

11. The method of claim 10 further including the step of selecting the color of the ink for the hot melt pre-formed image from a plurality of colors.

* * * * *